US005392999A

United States Patent [19]

König et al.

[11] Patent Number: 5,392,999

[45] Date of Patent: * Feb. 28, 1995

[54] ROTOR FOR IMPACT CRUSHERS OR HAMMER MILLS

[75] Inventors: Rolf König, Telgte; Gerhard Hemesath, Havixbeck, both of Germany

[73] Assignee: Noell Service und Maschinentechnik GmbH, Langenhagen, Germany

[ * ] Notice: The portion of the term of this patent subsequent to Jan. 17, 2012 has been disclaimed.

[21] Appl. No.: 662,009

[22] Filed: Feb. 28, 1991

[30] Foreign Application Priority Data

Mar. 1, 1990 [DE] Germany ..... 4006328.3

[51] Int. Cl.[6] ..... B02C 13/04

[52] U.S. Cl. ..... 241/194

[58] Field of Search ..... 241/191, 194; 228/140, 228/177, 189; 29/889, 889.6

[56] References Cited

U.S. PATENT DOCUMENTS

| | | | |
|---|---|---|---|
| 2,440,698 | 5/1948 | Patterson | 29/889 |
| 2,603,316 | 7/1952 | Pierce | 29/889 |
| 3,098,614 | 7/1963 | Meyer | 241/193 |
| 3,531,055 | 9/1970 | Alt | 241/192 |
| 4,651,934 | 3/1987 | Bender et al. | 241/36 |
| 5,004,169 | 4/1991 | Ostergaard | 241/192 |
| 5,188,303 | 2/1993 | Hoof | 241/194 |

FOREIGN PATENT DOCUMENTS

| | | | |
|---|---|---|---|
| 1589790 | 4/1970 | France . | |
| 0018653 | 11/1956 | Germany . | |
| 1257541 | 12/1967 | Germany . | |
| 6601200 | 2/1969 | Germany . | |
| 1808322 | 5/1970 | Germany . | |
| 2418619 | 11/1975 | Germany . | |
| 3137931 | 4/1983 | Germany | 241/191 |
| 3203324 | 8/1983 | Germany | 241/191 |
| 3317070 | 7/1984 | Germany . | |

*Primary Examiner*—John Husar
*Attorney, Agent, or Firm*—Horst M. Kasper

[57] ABSTRACT

A rotor for use in an impact crusher or in a hammer mill is assembled of two or more coaxial metallic discs having neighboring hubs and axially spaced apart radially outermost portions which define annular clearances for introduction of a welding implement. Such implement is used to apply annular welded seams which bond the ends of the hubs to each other. The welded seams are provided at the peripheral surfaces of the hubs. The hubs are mechanically coupled to each other by bolts prior to making of the welded seams. The radially outermost portions of the discs are thereupon connected with hammers or beater bars, depending on the intended use of the rotor.

23 Claims, 4 Drawing Sheets

ROTOR FOR IMPACT CRUSHERS OR HAMMER MILLS

BACKGROUND OF THE INVENTION

The invention relates to impact crushers, mills and similar machines in general, and more particularly to improvements in rotors which can be used in such machines to comminute coal, rock or other materials. Still more particularly, the invention relates to improvements in rotors which can be used with advantage in impact crushers or hammer mills.

It is known to assemble a rotor for use in an impact crusher or hammer mill from two or more metallic rotor discs which are welded to each other and have central portions or hubs serving to receive torque from a shaft. Neighboring discs are welded to each other at their peripheries, i.e., radially outwardly of the respective hubs. Reference may be had, for example, to U.S. Pat. No. 3,098,614 and to German Utility Model No. 66 01 200. Welded seams are desirable and advantageous because they lend the necessary rigidity and stability to the assembled rotor.

A drawback of welded seams which are provided at the periphery of a conventional rotor for use in a hammer mill is that the seams are necessarily interrupted, i.e., such seams can be said to constitute relatively small portions of circumferentially complete annuli because they are interrupted in the regions of the hammers. The same holds true for the conventional rotors of impact crushers. In addition, the welding operation which involves bonding together two or more discs to form the rotor of an impact crusher takes up much time and is complex and expensive. A further drawback of conventional rotors for use in hammer mills or impact crushers is that their interrupted welded seams are located at the periphery and are thus subject to much wear and tear as a result of contact with material which is being comminuted.

OBJECTS OF THE INVENTION

An object of the invention is to provide a novel and improved rotor for use in comminuting or crushing machines which is constructed and assembled in such a way that the connections between neighboring components of the rotor are shielded from material which is being comminuted.

Another object of the invention is to provide novel and improved connections between the hubs of discs in the rotor of a hammer mill or impact crusher.

Still another object of the invention is to provide a novel and improved method of bonding neighboring metallic discs of a rotor to each other in a time-saving and inexpensive way.

A further object of the invention is to provide an impact crusher which embodies a rotor of the above outlined character.

Another object of the invention is to provide a hammer mill which embodies the above outlined rotor.

An additional object of the invention is to provide novel and improved means for mechanically and integrally connecting the hubs of discs in a rotor for use in a crushing or comminuting machine, such as a hammer mill or an impact crusher.

SUMMARY OF THE INVENTION

The invention is embodied in a rotor for use in impact crushers or hammer mills. The improved rotor comprises at least two coaxial metallic discs (e.g., each disc can constitute a steel casting) having neighboring hubs, and at least one annular welded seam which bonds the hubs to each other. The at least one seam is preferably located at the outer edges of the peripheral surfaces of the hubs.

Neighboring discs or portions affixed to them shall define an annular clearance which enables a welding implement to reach the hubs by advancing substantially radially inwardly between the portions of the discs for making the welded seams.

The rotor can be provided with a rim which spacedly surrounds the respective hub. Also, the rims of the discs must define an annular clearance having a width such that a welding implement can pass through the clearance toward the hubs. The axial length of the hubs exceeds the axial length of the respective rims, particularly by the width of the clearance. The arrangement may be such that each hub extends axially beyond both axial ends of the respective rim by approximately half the width of the clearance between the rims.

The axial length of the hub of one of the discs can be greater than the axial length of the hub of another disc. This renders it possible to assemble a composite rotor having a desired axial length, for example, by assembling two or more discs having hubs of identical axial length or by assembling two or more discs with hubs having in part identical and in part different or only different axial lengths.

If the rotor is to be used in an impact crusher, every disc can include beater bar supports which are affixed to the periphery of the disc and the supporting surfaces of the supports are parallel to the common axis of the discs. The beater bar supports can be welded to the discs. Because of their interfering with access to the hubs, the annular welded seams mush be made prior to welding of the support to the discs.

If the rims of the discs provide the mounting surfaces for the beater bars, such surfaces are prefabricated prior to welding the discs together by making the annular welded seams.

If the rotor is to have a composite hub of considerable length without increasing or unduly increasing the number of the discs, the rotor can further comprise a distancing element (.e.g., a sleeve or cylinder) which is disposed between the hubs of two neighboring discs and bonded to them by welded annular seams. The outer diameter of the distancing element can be equal or at least approximate the outer diameters of the hubs which are welded thereto.

The novel features which are considered as characteristic of the invention are set forth in particular in the amended claims. The improved rotor itself, however, both as to its construction and the mode of assembling the same, together with additional features and advantages thereof, will be best understood upon perusal of the following detailed description of certain presently preferred specific embodiments with reference to the accompanying drawing.

BRIEF DESCRIPTION OF THE DRAWINGS

FIG, 9 is a fragmentary partly end elevational and partly transverse sectional view of a rotor for use in a relatively small impact crusher, the section being taken in the direction of arrows substantially as seen from the line 9—9 in FIG. 10.

DESCRIPTION OF PREFERRED EMBODIMENTS

Figure 1:
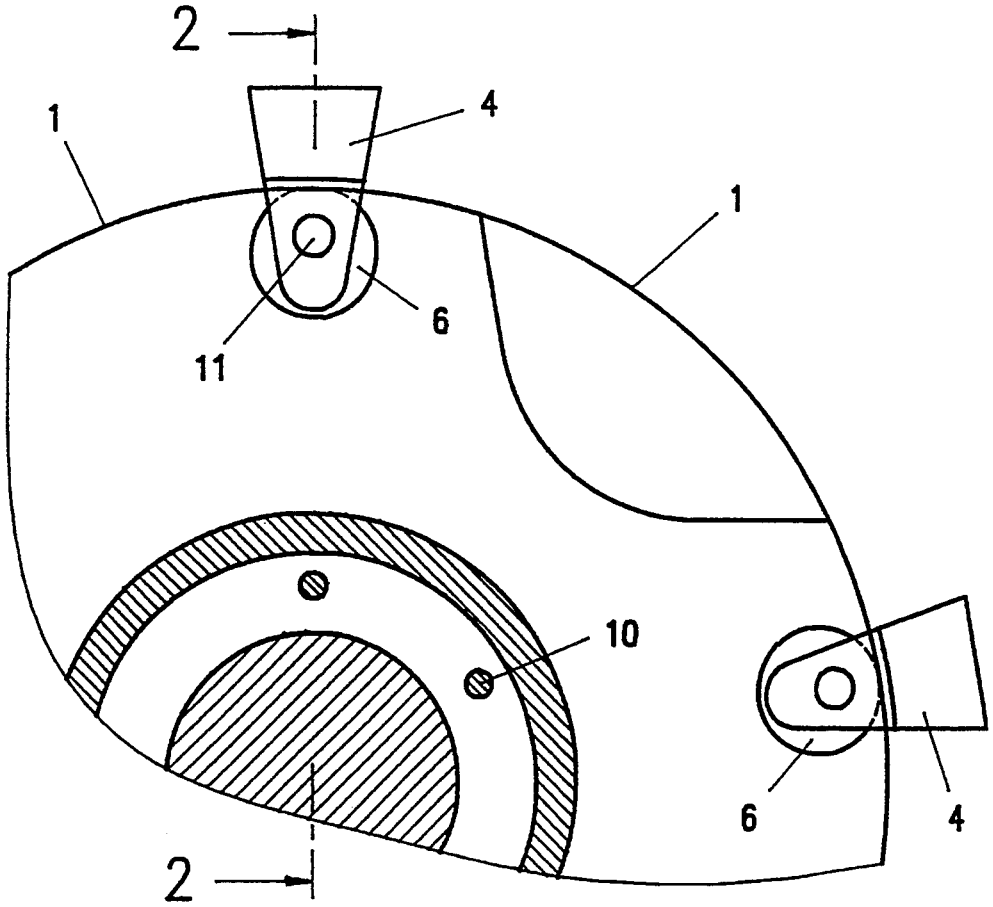
FIG. 1 is a fragmentary partly end elevational and partly transverse sectional view of a rotor which can be used in a hammer mill and embodies one form of the invention, the section being taken in the direction of arrows as seen from the line 1—1 in FIG. 2.
Figure 2:
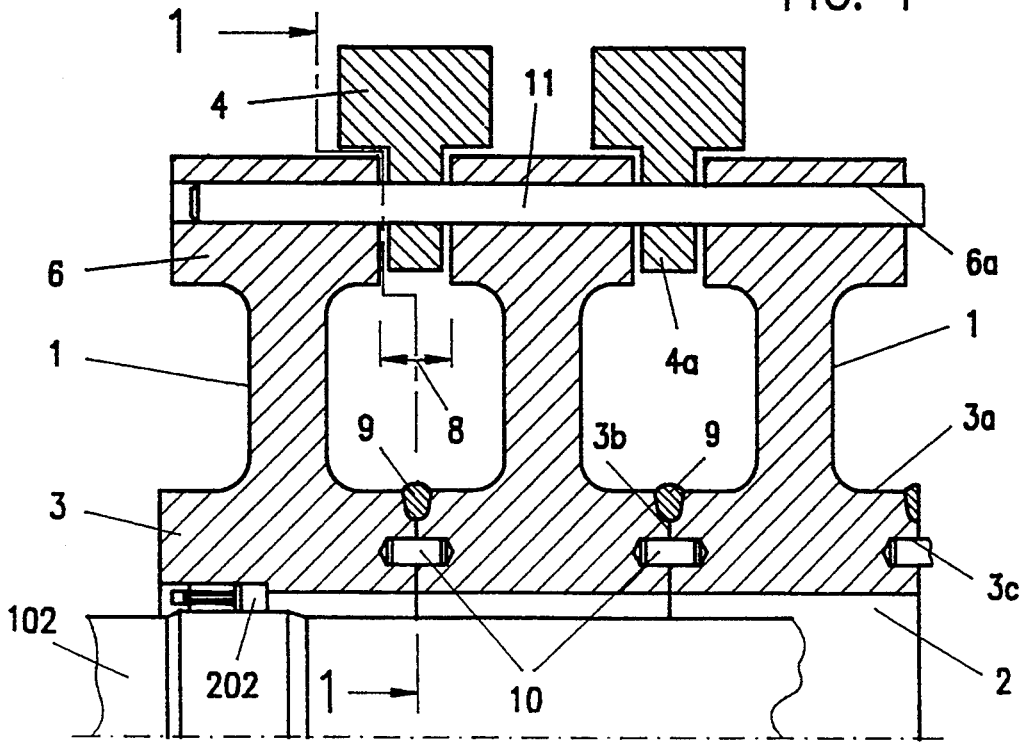
FIG. 2 is a fragmentary axial sectional view substantially as seen in the direction of arrows from the line 2—2 in FIG. 1.

The rotor which is shown in FIGS. 1 and 2 can be used with advantage in an otherwise standard hammer mill, e.g., a hammer mill of the type produced and distributed by the assignee of the present application. This rotor comprises several coaxial metallic discs 1 (such discs can be made of cast steel) each of which has a centrally located axially extending bore or hole 2 for a driver shaft 102 which is surrounded by suitable centering devices (one shown at 202). The holes 2 are defined by hubs 3 which constitute the radially innermost portions of the respective discs 1 and have cylindrical or substantially cylindrical peripheral surfaces 3*a* of identical diameters. The adjoining end faces 3*b* of the hubs 3 are provided with aligned recesses 3*c* (e.g., in the form of blind bores) for portions of locating and centering bolts 10 which prevent angular movements of neighboring hubs 3 relative to each other.

The radially outermost portions or rims 6 of the discs 1 are provided with axially parallel through holes or bores 6*a* for elongated retaining bolts 11 each of which serves to couple the discs 1 with several aligned hammers 4 of any known design. The length of radially outermost portions 6 (as seen in the axial direction of the rotor) is less than the length of the hubs 3 (the length of each of the three hubs 3 which are shown in FIG. 2 is assumed to be the same) so that the neighboring portions 6 define relatively narrow clearances or gaps 8 for the radially inwardly extending portions 4*a* of the hammers 4. The portions 4*a* of the hammers 4 of each row of hammers are traversed by a retaining bolt 11. FIG. 1 shows that the bolts 11 are spaced apart from each other by approximately 90 °, i.e., that the rotor including the discs 1 can carry four rows of aligned hammers 4. FIG. 1 further shows that neighboring hubs 3 can be mechanically coupled to each other by several locating and centering bolts 10.

In accordance with a feature of the invention, neighboring hubs 3 are bonded to each other by annular welded seams 9 each of which can constitute a circumferentially complete ring. Such seams are formed by a welding implement (not shown) which can be caused to extend radially inwardly between the respective radially outermost portions 6, i.e., through the respective clearances 8 and to the peripheral surfaces 3*a* of the hubs 3 which are to be bonded to each other by a welded seam 9. The welding operation is or can be carried out prior to mounting of the hammers 4 by means of the retaining bolts 11, i.e., at a time when the clearances 8 are unobstructed all the way around the hubs 3. The arrangement is preferably such that, once the working end of a welding implement is introduced through a clearance 8 and assumes an operative position relative to the adjacent hubs 3, the discs 1 (which are mechanically coupled to each other by the bolts 10) are slowly turned about their common axis (defined by the shaft 102) in order to enable the implement to make a welded seam 9. The procedure is then repeated as often as necessary to make the other seam or seams 9. If necessary, the two outermost hubs 3 can be clamped and urged toward each other in the course of each welding or bonding operation to thus ensure that the axial positions of the hubs 3 which are being permanently bonded to each other does not change while the welding implement is in the process of making a seam 9.

When the making of the seams 9 is completed, the assembly of the rotor is resumed or continued, i.e., the hammers 4 are connected to the radially outermost portions 6 of the discs 1 by means of the retaining bolts 11.

The axial length of each radially outermost portion 6 can be M–m wherein M is the axial length of a hub 3 and m is the width of a clearance 8. The arrangement is preferably such that each hub 3 extends beyond both axial ends of the respective radially outermost portion 6 by m/2, i.e., by half the width of a clearance 8. This does not unduly weaken the radially outermost portions 6, i.e., such portions can reliably retain the bolts 11 and the hammers 4 or any other marts (see the beater bars 5 of FIG. 3) which are to be mounted on the rotor to carry out a comminuting action.

The width of the clearances 8 need not appreciably exceed 50 mm and can be less. Such clearances afford access to the peripheral surfaces 3*a* of the hubs 3 without unduly weakening the radially outermost portions 6 which constitute supports for the bolts 11 and hammers 4.

An important advantage of the improved rotor is that the welded seams 9 are remote from the hammers 4, i.e., that they are not in direct contact with the material which is being comminuted in an impact crusher embodying the rotor of FIGS. 1 and 2.

Another important advantage of the improved rotor is that the peripheral surfaces 3*a* of the hubs 3 can be reached by a suitable welding implement in spite of the presence of radially outermost portions 6. This is due to the aforediscussed dimensioning of the hubs 3 and of the radially outermost portions 6, i.e., the radially outermost portions 6 define annular clearances 8 through which a welding implement can extend to reach the locations for the making of welded seams 9 in spite of the fact that the peripheral surfaces 3*a* of the hubs 3 are much closer to the axis of the assembled rotor than the peripheral surfaces of the radially outermost portions 6. As mentioned above, heretofore known rotors are constructed in such a way that the radially outermost portions of the discs are welded to each other by resorting to hand-held equipment.

The welded seams 9 which are shown in FIG. 2 can be formed in a simultaneous operation by using a corresponding number of welding implements each of which extends radially inwardly through one of the clearances 8 (prior to mounting of the hammers 4 and prior to insertion of the retaining bolts 11) while the discs 1 slowly rotate as a unit with or about the axis of the shaft 102.

German Auslegeschrift No. 18 08 322 discloses a rotor with circular discs having radially innermost portions welded to a drum which serves as a shaft. However, each disc is a composite structure which is assembled of several sectors and such sectors are offset relative to each other in the axial direction of the rotor. Thus, the connections between the composite discs and the shaft are not annular welded seams but rather mere fragments or small portions of ring-shaped seams. Moreover, the bonding of sectors to the shaft is a complex and time-consuming operation and the assembled rotor is often unsatisfactory due to unacceptable eccentricity of its components. Still further, it is necessary to provide two sets of welded seams for each disc which is part of the rotor in the aforementioned Auslegeschrift.

The improved rotor merely requires a single annular welded seam 9 for each pair of neighboring hubs 3. Moreover, the permanent (welded) connections between neighboring hubs 3 are rugged and highly reliable. Therefore, it is not necessary to mount the improved rotor on a shaft (102) which extends all the way from the left-hand axial end of the left-hand hub 3 to the right-hand axial end of the right-hand hub 3 (as seen in FIG. 2), i.e., it suffices to slid only a portion of the composite hub onto a portion of the shaft 102. Such mounting exhibits the advantage that it is not necessary to machine, with a high degree of precision, the entire surface bounding the central opening of the composite hub, i.e., it suffices to precision finish the internal surfaces of the two outermost hubs 3 or to precision finish only portions of the internal surfaces of these hubs.

Further important advantages of the improved rotor are its simplicity and low cost. Thus, each disc 1 is a relatively simple and inexpensive component, and each such disc can be permanently bonded to the adjacent disc by a single annular welded seam 9.

Figure 3:
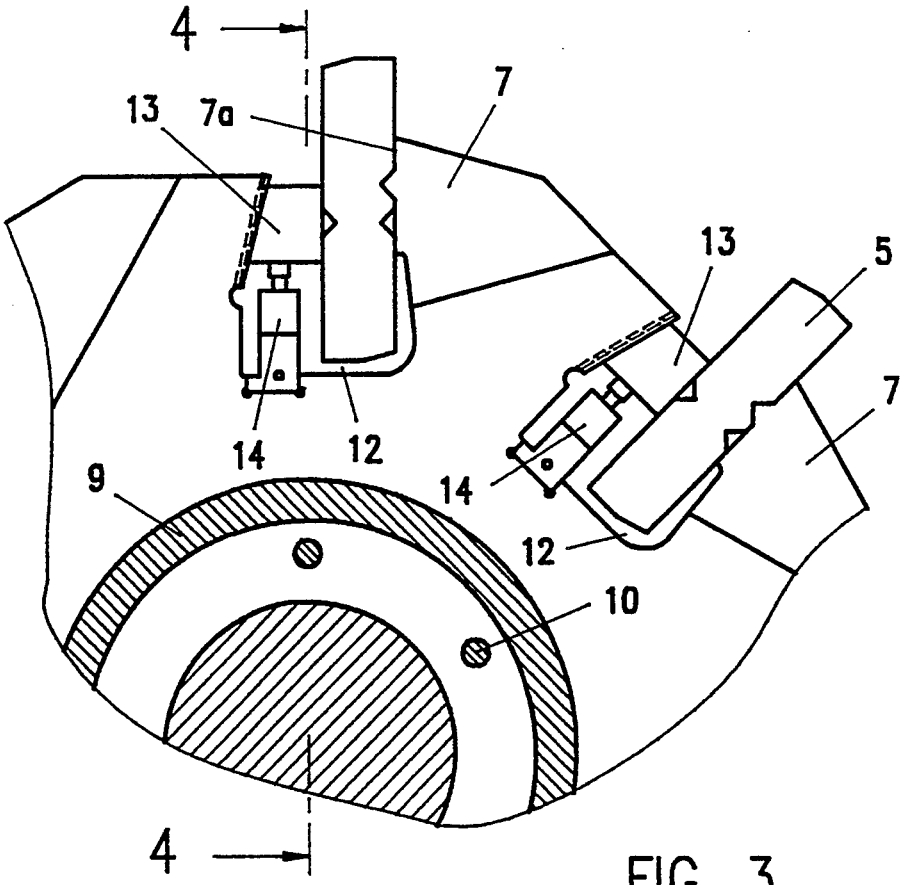
FIG. 3 is a partly end elevational and partly transverse sectional view of a rotor which can be used in an impact crusher and embodies another form of the invention, the section being taken in the direction of arrows as seen from the line 3—3 in FIG. 4.
Figure 4:
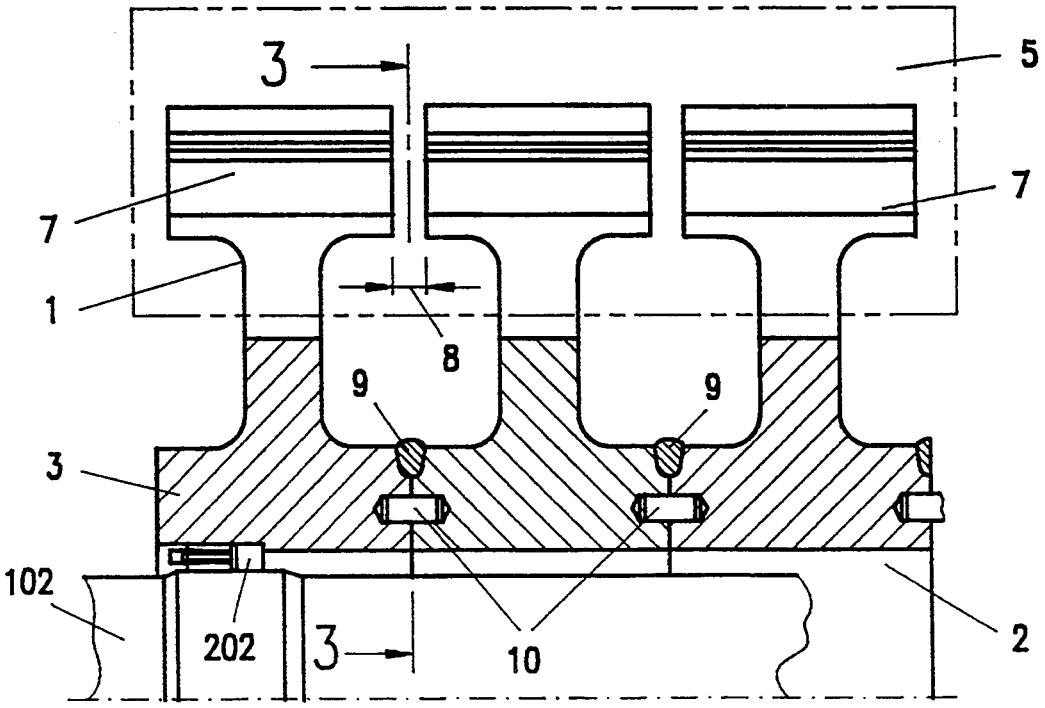
FIG. 4 is a fragmentary axial sectional view substantially as seen in the direction of arrows from the line 4—4 in FIG. 3.

FIG. 3 and 4 show a portion of a modified rotor which can be used in an impact crusher, e.g., an otherwise standard impact crusher of the type produced and distributed by the assignee of the present application. All such parts of the rotor of FIGS. 3 and 4 which are identical with or clearly analogous to corresponding parts of the rotor of FIGS. 1 and 2 are denoted by similar reference characters. The main difference is that the rims 7 of the discs 1 which are shown in FIGS. 3 and 4 are designed to support elongated axially parallel beater bars 5. The rims 7 are provided with cutouts 12 which are open at the peripheries of the discs 1 in order to permit insertion of a beater bar 5 into each of a series of aligned cutouts. Once inserted, the beater bars 5 are fixedly held by wedges 13 which are biased by thrust elements 14 to prevent radially outward movements of the beater bars along the prefabricated (e.g., flat or substantially flat) surfaces 7*a* of the radially outermost portions 7.

The clearances 8 between the rims 7 of neighboring discs permit introduction of a welding implement (not shown) which is used to make the welded seams 9 between neighboring hubs 3. Such welding operation is carried out prior to introduction of beater bars 5 into their respective cutouts 12, i.e., while the access to clearances 8 is unobstructed all the way around the discs 1.

Figure 5:
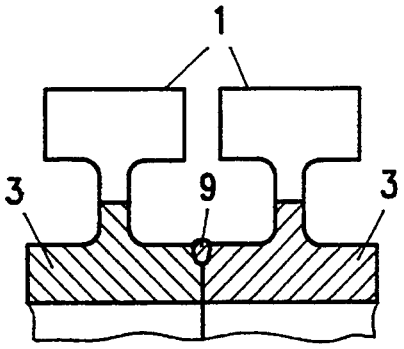
FIG. 5 is a fragmentary axial sectional view of a rotor having two discs with hubs of identical axial length.

FIG. 5 shows portions of two identical discs 1, i.e., of discs having hubs 3 of identical axial length.

Figure 6:
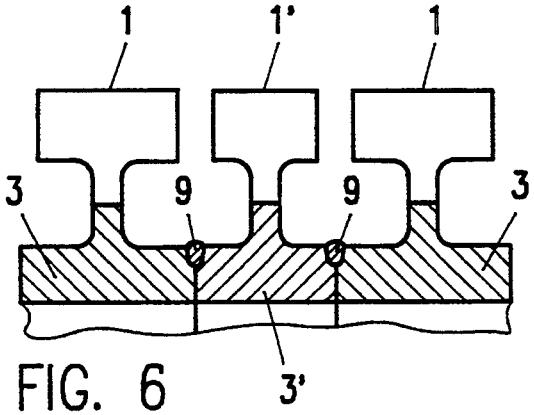
FIG. 6 is a fragmentary axial sectional view of a rotor with three discs two of which have longer hubs.

FIG. 6 shows portions of two identical outer discs 1 and a modified disc 1' between the discs 1. The hub 3' of the median disc 1' is shorter than the hubs 3 (as seen in the axial direction of the rotor). An advantage of the provision of discs having different axial lengths is that it is possible to assemble rotors the axial length of which is not a whole multiple of the axial length of a hub 3 or 3'.

Figure 7:
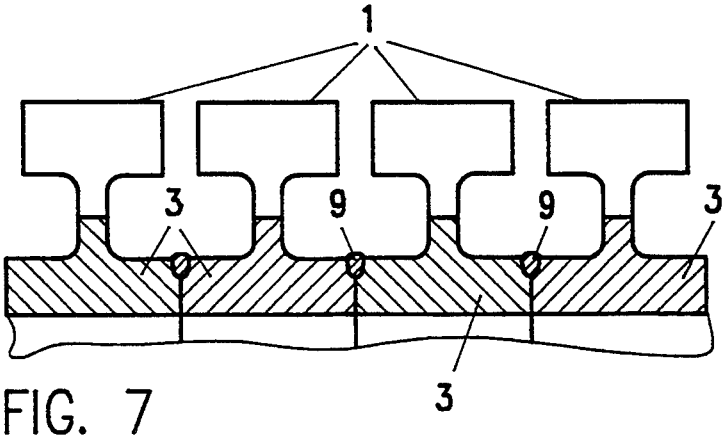
FIG. 7 is a fragmentary axial sectional view of a rotor with four discs having hubs of identical axial length.
Figure 8:
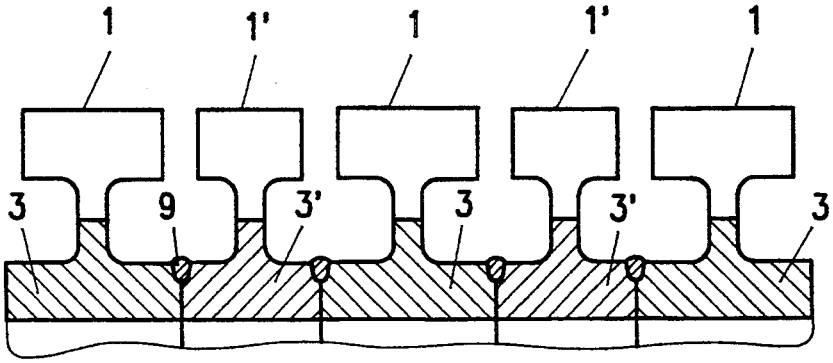
FIG. 8 is a fragmentary axial sectional view of a rotor having five discs, three with longer hubs and two with shorter hubs.

The rotor of FIG. 7 comprises four identical discs 1, and the rotor of FIG. 8 comprises five discs, namely three discs 1 and two discs 1' which alternate with the discs 1.

It is clear that the improved rotor can comprise more than five discs and/or that the discs of a rotor can include one or more discs with hubs having a length m1, one or more discs having a length m2, one or more discs having a length m3, and so forth.

By maintaining a supply of discs having different axial lengths, the manufacturer of improved rotors can satisfy a range of different orders with a relately small stock of discs.

Figure 9:
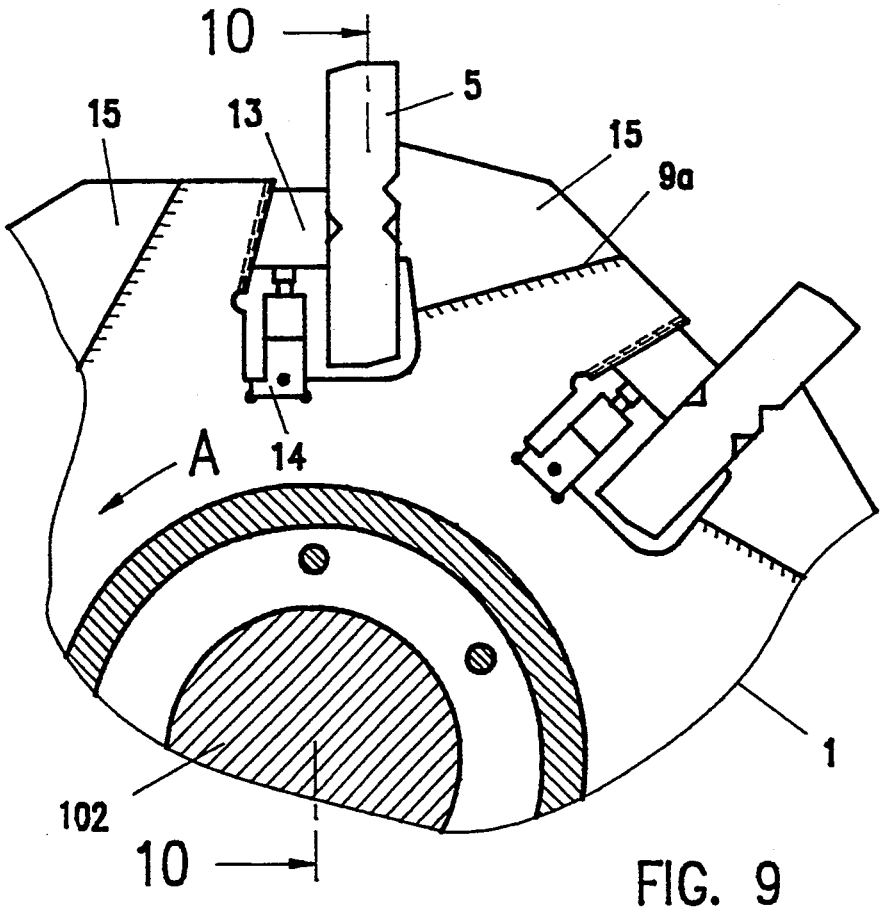
Figure 10:
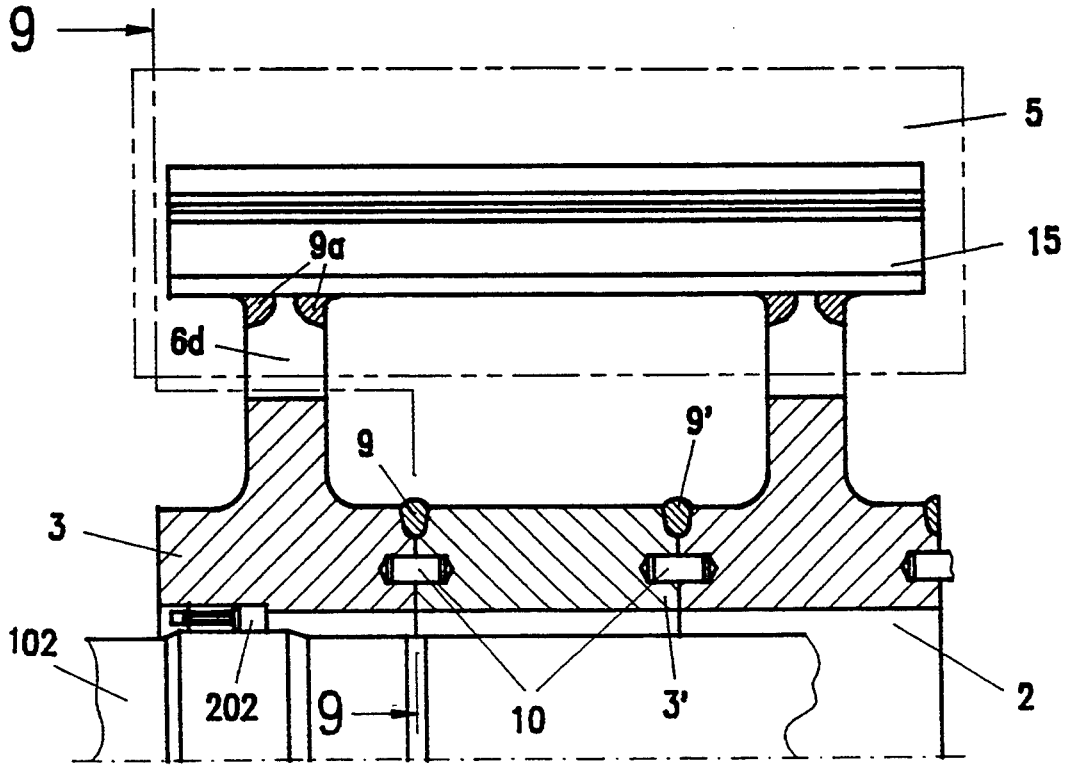
FIG. 10 is a fragmentary axial sectional view substantially as seen in the direction of arrows from the line 10—10 in FIG. 9.

FIGS. 9 and 10 show a portion of a rotor which can be used in a relatively small impact crusher. The rotor of FIGS. 9 and 10 constitutes a modification of the rotor which is shown in FIGS. 3 and 4.

The radially outermost portions 6*d* of the discs 1 which are shown in FIGS. 9 and 10 differ from the radially outermost portions 7 shown in FIGS. 3 and 4 in that they are shorter (as seen in the axial direction of the rotor) and are welded, as at 9*a*, to axially parallel supports 15 for beater bars 5. Each support 15 can constitute an elongated one-piece metallic member which is bonded to the radially outermost portions 6*d* of the discs 1 by a pair of welded seams 9*a*. Such welded seams are made subsequent to making of the welded seams 9 and 9' at the peripheries of the hubs 3. The two hubs 3 which are shown in FIG. 10 are welded to the respective ends of a hollow cylindrical or sleeve-like metallic distancing element 3'. This distancing element 3' can be said to constitute an axial extension of the left-hand or right-hand hub 3, i.e., the left-hand welded seam 9 of FIG. 10 can be said to bond the left-hand hub 3 to the integral extension 3' of the right-hand hub 3, or the right-hand welded seam 9' can be said to bond the right-hand hub 3 to the integral extension 3' of the left-hand hub 3.

The welding equipment which is used to make the seam 9', the seams 9 and/or the seams 9*a* can be operated by hand but it is equally possible to employ a semi-automatic or fully automatic welding machine.

Save for the aforedescribed novel features, the rotor of FIGS. 9 and 10 can be said to resemble rotors of the type disclosed, for example, in U.S. Pat. No. 3,531,055. This patent describes a rotor with support beams for beater bars.

The supports 15 are located behind the respective beater bars 5 (see the arrow A in FIG. 9; this arrow indicates the direction of rotation of the rotor in a relatively small impact crusher).

Any surfaces which require precision finish are preferably treated prior to making of the welded seams. Thus, any surfaces on the radially outermost portions of the discs 1 or 1' can be precision finished prior to making of the welded seams 9 and/or 9'. For example, the surfaces *7a* of the radially outermost portions or rims 7 which are shown in FIGS. 3 and 4 will be finished prior to making of the seams 9. The majority of surfaces on the discs 1 or 1' need not be machined with any high degree of precision or require no finishing at all. This contributes to lower cost of the rotor. The holes or bores *3c* and *6a* for the centering bolts 10 and retaining bolts 11 (if needed) can be formed with a very high degree of precision irrespective of the finish of other portions of the discs, and the making of such holes or bores can be carried out at a low cost by resorting to available machinery. All in all, the improved rotor exhibits a host of important and desirable characteristics including compactness, low cost, stability, ruggedness and convenient access to parts which require frequent inspection or replacement.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A rotor body for impact crushers or hammer mills comprising at least two coaxial steel casting discs having hubs with an axial length greater than the thickness of said discs and surpassing the discs at both sides, whereby the hubs of neighboring discs contact each other and are bonded to each other by annular welded seams, the axial length of the hubs is such, that neighboring discs or objects affixed to them before bonding the hubs define an annular clearance between the discs over the whole circumference which enables a welding implement to roundabout reach said hubs.

2. The rotor body of claim 1, wherein said seams are located at the outer edges of the peripheral surfaces of said hubs.

3. The rotor body of claim 1, wherein neighboring discs or objects affixed to them define an annular clearance over the whole circumference which enables a welding implement to roundabout reach said hubs by advancing inwardly between said discs or objects.

4. The rotor body of claim 1, for use in an impact crusher, wherein each of said discs has a rim which spacedly surrounds the respective hub, the rims of neighboring discs defining an annular clearance over the whole circumference having a width such that a welding implement can pass therethrough toward said hubs.

5. The rotor body of claim 4, wherein each of said hubs extends in axial direction over the respective rim by at least half the width of said clearance.

6. The rotor body of claim 1, consisting of a plurality of discs, the hubs of which have different lengths in axial direction.

7. The rotor body of claim 1, for use in an impact crusher, wherein every disc comprises a beater bar support affixed to said disc, the supporting faces of the beater bar support being parallel to the common axis of the discs.

8. The rotor body of claim 7, wherein a common beater bar is affixed to all the said discs after making the said annular welded seams.

9. The rotor body of claim 7, wherein all parts of the discs, which had to be worked, are prefabricated prior to making said annular welded seams.

10. The rotor body of claim 1, further comprising a tubular distancing element disposed between two neighboring hubs, said annular welded seams bonding said distancing element to the said hubs.

11. A rotor for impact crushers or hammer mills comprising a metallic rotor for comminuting having at least two coaxial metallic discs formed as weldable metalic disks and having neighboring hubs; and annular welded seams bonding said hubs to each other.

12. The rotor of claim 11, wherein said weldable metallic discs are steel castings.

13. The rotor of claim 11, wherein said hubs have peripheral surfaces and said seams are located at the outer edges of said peripheral surfaces.

14. The rotor of claim 11, wherein neighboring weldable metalic discs or portions affixed to them define an annular clearance which enables a welding implement to reach said hubs by advancing substantially radially inwardly between said discs or portions.

15. The rotor of claim 11 for use in an impact crusher, wherein each of said weldable metalic discs has a rim which spacedly surrounds the respective hub, the rims of neighboring discs defining an annular clearance having a width such that a welding implement can pass therethrough toward said hubs.

16. The rotor of claim 15, wherein each of said hubs extends axially beyond both axial ends of the respective rim by approximately half the width of said clearance.

17. The rotor of claim 11, consisting of a plurality of discs, wherein the hubs exhibit different lengths in axial direction.

18. The rotor of claim 11 for use in an impact crusher, wherein every disc comprises one beater bar support affixed to said disc being prefabricated and their mounting faces for the beater bars being parallel to the common axis of the discs.

19. The rotor of claim 18, wherein one common beater bar support is affixed to all the said discs after making the said annular welded seams.

20. The rotor of claim 11, wherein said surfaces are prefabricated prior to making the said annular welded seams.

21. The rotor of claim 11, further comprising a distancing element disposed between two neighboring hubs, said annular welded seams bonding said distancing element to one of said neighboring hubs wherein the annular hubs and the distancing element are held together by said annular welded seams.

22. A rotor for impact crushers or hammer mills comprising at least two coaxial steel casting discs having hubs with an axial length greater than the thickness of said discs and surpassing the discs at both sides, whereby the hubs of neighboring discs contact each other and are bonded to each other by annular welded seams, the axial length of the hubs is such, that neighboring discs or objects affixed to them before bonding the hubs define an annular clearance between the discs over the whole circumference which enables a welding implement to roundabout reach said hubs.

23. The rotor of claim 22, wherein said seams are located at the outer edges of the peripheral surfaces of said hubs.

* * * * *